US012550949B2

(12) United States Patent
Cubas Ray

(10) Patent No.: US 12,550,949 B2
(45) Date of Patent: Feb. 17, 2026

(54) COLLAR WITH STOWAGE POUCH

(71) Applicant: HONEYWELL SAFETY PRODUCTS USA, INC., Charlotte, NC (US)

(72) Inventor: Lisa Cubas Ray, Centerville, OH (US)

(73) Assignee: Honeywell Safety Products USA, Inc., Latham, NY (US)

( * ) Notice: Subject to any disclaimer, the term of this patent is extended or adjusted under 35 U.S.C. 154(b) by 73 days.

(21) Appl. No.: 17/356,132

(22) Filed: Jun. 23, 2021

(65) Prior Publication Data

US 2022/0408846 A1 Dec. 29, 2022

(51) Int. Cl.
*A41B 3/00* (2006.01)
*A41B 3/02* (2006.01)
*A41D 13/05* (2006.01)

(52) U.S. Cl.
CPC ..... *A41B 3/02* (2013.01); *A41D 13/0512* (2013.01); *A41D 13/0562* (2013.01)

(58) Field of Classification Search
CPC ..... A41D 13/0512; A41D 13/02; A41B 3/00; A41B 3/02
See application file for complete search history.

(56) References Cited

U.S. PATENT DOCUMENTS 1,629,840 A * 5/1927 Rolnick ..... A41D 3/02 2/85
3,914,798 A * 10/1975 O'Keefe ..... A41D 11/00 2/80
4,771,479 A * 9/1988 Silver ..... A41D 3/00 2/93
4,937,884 A * 7/1990 Sherman ..... A41B 3/00 2/60
5,115,516 A * 5/1992 Golde ..... A41D 23/00 2/84
5,251,336 A * 10/1993 Nevins ..... A42B 1/046 2/205
5,369,809 A * 12/1994 Hall ..... A41D 3/00 2/202
5,400,438 A * 3/1995 Staff ..... A41D 27/18 2/108
5,966,747 A * 10/1999 Crupi ..... F41H 1/02 2/2.5
6,874,170 B1 * 4/2005 Aaron ..... A42B 3/0473 2/468
6,904,885 B2 * 6/2005 Osband ..... F02B 75/22 123/41.31
6,934,970 B1 * 8/2005 Watkins ..... A41D 13/0512 2/96
7,302,710 B2 * 12/2007 Thomas ..... A41D 1/04 2/84

(Continued)

*Primary Examiner* — Richale L Quinn
(74) *Attorney, Agent, or Firm* — Fredrikson & Byron, P.A.

(57) ABSTRACT

A protective apparel having a collar is disclosed. The collar defines a stowage pouch. The protective apparel comprises a foldable chinstrap having a first end and a second end. The first ends of the foldable chinstrap is disposed within the stowage pouch and the second end is attached to an interior surface of the collar in a folded configuration. The foldable chinstrap transitions from the folded configuration to an unfolded configuration when the second end of the foldable chinstrap is separated from the interior surface of the collar and extended to attach to an exterior surface of the collar.

20 Claims, 7 Drawing Sheets

(56) References Cited

U.S. PATENT DOCUMENTS

| | | | | |
|---|---|---|---|---|
| 7,467,422 | B2 * | 12/2008 | Bugarin | A42B 1/046 2/202 |
| 8,955,165 | B1 * | 2/2015 | Romero | A41D 23/00 2/101 |
| 9,521,873 | B1 * | 12/2016 | Mignone | A41D 3/005 |
| 9,565,880 | B2 * | 2/2017 | Romero | A41D 3/02 |
| 10,722,403 | B2 * | 7/2020 | Saladino | A61F 9/029 |
| 11,259,581 | B2 * | 3/2022 | Saladino | A41D 15/002 |
| 11,793,252 | B1 * | 10/2023 | Kaufman | A41D 15/04 |
| 12,150,505 | B2 * | 11/2024 | York | A62B 17/001 |
| 2005/0160514 | A1 * | 7/2005 | Flaniken | A41D 3/005 2/84 |
| 2014/0096305 | A1 * | 4/2014 | Friesen | A41D 15/04 2/84 |
| 2014/0343599 | A1 * | 11/2014 | Smith | A61H 39/04 606/202 |
| 2016/0015099 | A1 * | 1/2016 | Saladino | A42B 1/048 2/173 |
| 2016/0183612 | A1 * | 6/2016 | Romero | A41D 23/00 2/98 |
| 2019/0200692 | A1 * | 7/2019 | Saladino | A41D 15/002 |
| 2019/0297966 | A1 * | 10/2019 | Wisniewski | A41D 13/0512 |
| 2020/0375278 | A1 * | 12/2020 | Kerr | D02G 3/22 |
| 2022/0160061 | A1 * | 5/2022 | Saladino | A42B 1/206 |

* cited by examiner

COLLAR WITH STOWAGE POUCH

TECHNOLOGICAL FIELD

Example embodiments of the present disclosure relate generally to protective apparels and jackets, and more particularly, to a jacket having a collar with a stowage pouch for receiving a chinstrap.

BACKGROUND

Firefighters wear protective gear to provide protection from intense heat associated with firefighting. The protective gear typically protects the firefighters from many other dangers including flashovers and smoke explosions. A typical firefighting ensemble includes fire boots, fire pants, a fire coat, fire gloves, a face mask, a Self-Contained Breathing Apparatus (SCBA), fire hood and a hard hat fire helmet. The fire helmet protects face and neck in the areas where the firefighter's mask does not cover.

BRIEF SUMMARY

The illustrative embodiments of the present disclosure relate to a garment used by firefighters. The garment comprises a collar defining a stowage pouch, and a foldable chinstrap. The collar defines two spaced-apart sections and the foldable chinstrap has a first end and a second end. The first end of the foldable chinstrap is disposed within the stowage pouch of the collar and the second end is attached to an interior surface of a first section of the two spaced-apart sections in a folded configuration. The foldable chinstrap transitions from the folded configuration to an unfolded configuration when the second end of the foldable chinstrap is separated from the interior surface of the first section and attached to an exterior surface of a second section of the two spaced-apart sections.

In an example embodiment, the first end of the foldable chinstrap is stitched to the collar.

In an example embodiment, a portion of the foldable chinstrap disposed within the stowage pouch is made of elastic material.

In an example embodiment, the second end of the foldable chinstrap is removably attached to the interior surface of the first section in the folded configuration.

In an example embodiment, the second end is coupled to the interior surface of the first section via a hook-and-pile.

In an example embodiment, the stowage pouch extends along a portion of length of the collar.

In an example embodiment, a jacket having a collar, wherein the collar has two spaced-apart sections is disclosed. A first section of the two spaced-apart sections defines a stowage pouch extending along a portion of length of the first section, and the stowage pouch is configured to receive a first end of a foldable chinstrap. A second section of the two spaced-apart sections has a hook-and-pile attachment on an exterior surface of the second section, and the second section is configured to allow a second end of the foldable chinstrap to attach to the second section.

In an example embodiment, the stowage pouch has a predefined length configured to receive a portion of the foldable chinstrap.

In some embodiments, an exterior surface of the collar comprises an attachment configured to attach the first end of the foldable chinstrap to the exterior surface of the collar.

In an example embodiment, the second end of the foldable chinstrap is configured to be removably attached to the interior surface of the first section in a folded configuration.

In some embodiments, the first end of the foldable chinstrap is configured to be stitched to an exterior surface of the collar within the stowage pouch.

In an example embodiment, a protective apparel is disclosed. The protective apparel comprises a collar defining a stowage pouch extending along a portion of length of the collar, and a portion of a foldable chinstrap is disposed within the stowage pouch. A first end of the foldable chinstrap is attached to an exterior surface of the collar within the stowage pouch, and a second end of the foldable chinstrap is removably attached to an interior surface of the collar in a folded configuration, and wherein the second end of the foldable chinstrap is configured to be removed from the interior surface of the collar and extended to attach to the exterior surface of the collar.

In an example embodiment, a portion of the foldable chinstrap, in the folded configuration, is disposed within the stowage pouch and a remaining portion of the foldable chinstrap is disposed outside the stowage pouch.

In an example embodiment, the first end of the foldable chinstrap is stitched to the exterior surface of the collar within the stowage pouch.

In an example embodiment, a portion of the foldable chinstrap disposed within the stowage pouch is made of elastic material.

In some embodiments, the second end is coupled to the interior surface of the collar, in the folded configuration, via a hook-and-pile.

In various embodiments, the exterior surface of the collar comprises a hook-and-pile configured to attach the second end to the exterior surface.

In an example embodiment, the second end of the foldable chinstrap comprises a hook-and-pile attachment.

In an example embodiment, the foldable chinstrap has a predefined shape and dimension to allow insertion of the foldable chinstrap into the stowage pouch and removal of the foldable chinstrap from the stowage pouch.

In an example embodiment, the collar comprises two spaced-apart sections.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1A:
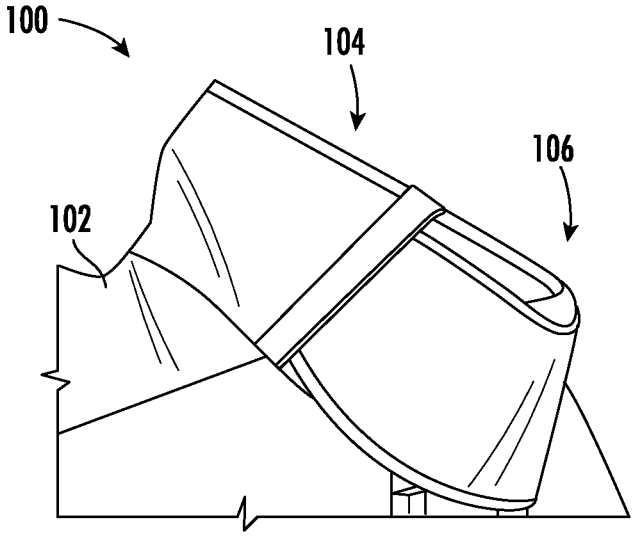
FIGS. 1A, 1B and 1C illustrate various views of a collar and a foldable chinstrap, in accordance with an example embodiment of the present disclosure.

Some embodiments of the present disclosure will now be described more fully hereinafter with reference to the accompanying drawings, in which some, but not all embodiments are shown. Indeed, the disclosure may be embodied in many different forms and should not be construed as limited to the embodiments set forth herein; rather, these embodiments are provided so that this disclosure will satisfy applicable legal requirements. The terms "or" and "optionally" are used herein in both the alternative and conjunctive sense, unless otherwise indicated. The terms "illustrative" and "exemplary" are used to be examples with no indication of quality level. Like numbers refer to like elements throughout.

Chinstraps are essential components of a protective gear and protect a firefighter's neck region and a face region from exposure to intense heat. However, when a chinstrap is not in use and not engaged to the protective gear, the chinstrap dangles around the collar of the jacket worn by the firefighter and causes interference with the visibility of the firefighter. The firefighter, on may instances, cuts off and separates the chinstrap or a portion of the chinstrap from the protective gear. The removal of the chinstrap causes a safety issue as the face region and the neck region may be exposed to intense heat in absence of the chinstrap.

Various example embodiments described in present disclosure relates to a protective apparel, a garment or a jacket worn by the firefighter during firefighting. The protective apparel has a collar that defines a stowage pouch to receive a chinstrap. The chinstrap has two ends, a first end and a second end. When the chinstrap is not in use or not connected to the protective gear, the second end of the chinstrap is folded and attached to an interior surface of the collar. The first end of the chinstrap is attached to an exterior surface of the collar within the stowage pouch. In an example, the second end has a hook-and-pile attachment to attach to the exterior surface. In the folded configuration, a portion of the chinstrap is disposed within the stowage pouch and a remaining portion is disposed outside the stowage pouch, such that the firefighter or a user wearing the protective apparel can grab the portion outside the stowage pouch and pull the second end of the chinstrap when required to wrap around the collar. In use, when the firefighters require the chinstrap to be wrapped around the collar for protecting a neck region and a face region of the firefighter, the second end is removed from the interior surface of the collar and extended to attach to an exterior surface of the collar by the firefighter. The exterior surface of the collar comprises a hook-and-pile attachment to receive the second end of the chinstrap. The hook-and-pile attachment allows easy coupling and decoupling of the second end of the chinstrap from the exterior surface of the collar. The collar and the chinstrap provides the benefit of folding the chinstrap onto the collar when the chinstrap is not in use or not connected to the protective gear. One skilled in the art would understand that the chinstrap described herein, is not limited to embodiments of firefighters, and can be used on collars of garments in any field of use.

The details regarding the jacket having the collar and the chinstrap and their operation is described in detail with reference to subsequent figures.

The components illustrated in the figures represent components that may or may not be present in various example embodiments described herein such that embodiments may include fewer or more components than those shown in the figures while not departing from the scope of the disclosure.

Turning now to the drawings, the detailed description set forth below in connection with the appended drawings is intended as a description of various example configurations and is not intended to represent the only configurations in which the concepts described herein may be practiced. The detailed description includes specific details for the purpose of providing a thorough understanding of various concepts with like numerals denoting like components throughout the several views. However, it will be apparent to those skilled in the art of the present disclosure that these concepts may be practiced without these specific details.

Figure 1B:
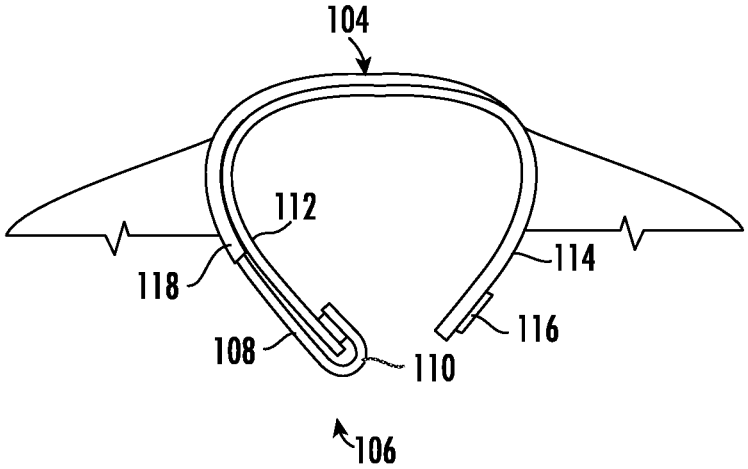
Figure 1C:
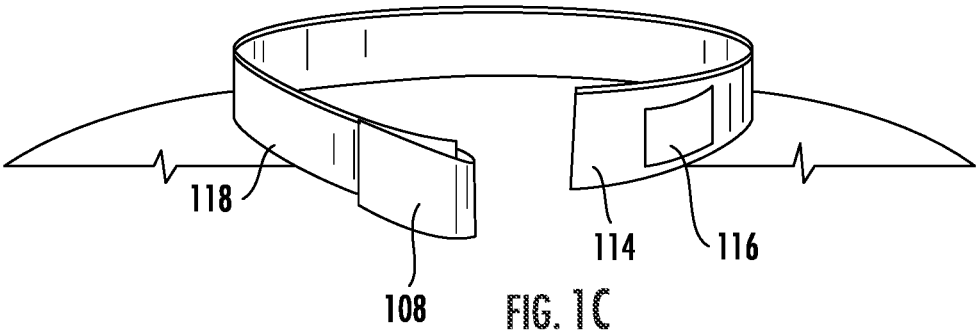

FIGS. 1A, 1B and 1C illustrate various views 100 of the jacket 102 and the collar 104, in accordance with an example embodiment of the present disclosure. FIG. 1A illustrates a perspective view, FIG. 1B illustrates a top view and FIG. 1C illustrates a front view of the jacket 102 and the collar 104, respectively. In an example embodiment, the jacket 102 may refer to a protective apparel or a garment such as, a fire coat, or a blazer worn by the firefighter during firefighting.

As shown in FIGS. 1A, 1B and 1C, a foldable chinstrap 106 is disposed within the collar 104. The foldable chinstrap 106 has a first segment 108 and a second segment 110. The collar 104 has two spaced-apart sections 112 and 114 separated by a gap. The second section 114 of the foldable chinstrap 106 has a hook-and-pile attachment 116 on an exterior surface of the second section 114. In an example, the collar 104 defines a stowage pouch 118 extending from the first section 112 to the second section 114 of the collar 114, and the foldable chinstrap 106 is inserted within the stowage pouch 118.

In an alternative embodiment, the second section 114 of the two spaced-apart sections defines the stowage pouch (not shown in the figure) and the foldable chinstrap 106 is inserted within the stowage pouch of the second segment 110. In the alternative embodiment, the first section 112 of the foldable chinstrap 106 has a hook-and-pile attachment (e.g. Velcro™) on an exterior surface of the first section 112.

Referring to FIGS. 1A, 1B and 1C, the first segment 108 and the second segment 110 are folded in a folded configuration. In the folded configuration, a portion of the first segment 108 is disposed within the stowage pouch 118 and another portion of the first segment 108 is disposed on one side of first section 112 and the second segment 110 is folded over the first section 112 to attach to an interior surface of the first section 112. The foldable chinstrap 106 is folded over the first section such that a portion of the foldable chinstrap 106 is protruded out adjacent the first section 112 of the collar 104. The protruded portion of the foldable chinstrap 106 makes it easy for the firefighter or a user to grab the second segment 110, pull out the second segment 110 and extend the foldable chinstrap 106 across the gap of the collar 104 to the second section 114. On the second section 114, the second segment 110 of the foldable chinstrap 106 is attached to the hook-and-pile attachment 116. In an example, a portion of the first segment 108 disposed within the stowage pouch 118 is made of elastic material, and is referred to as an elastic portion, hereinafter. When the foldable chinstrap 106 is in use and attached to the exterior surface of the second section 114, the elastic portion (as shown in FIG. 2A) stretches and when the chinstrap is not in use, the elastic portion retracts thereby pulling the chinstrap 106 into the stowage pouch 118.

The details of the collar 104, the foldable chinstrap 106, and stowing of the foldable chinstrap 106 within the collar 104 is described in more details with reference to subsequent figures.

Figure 2A:
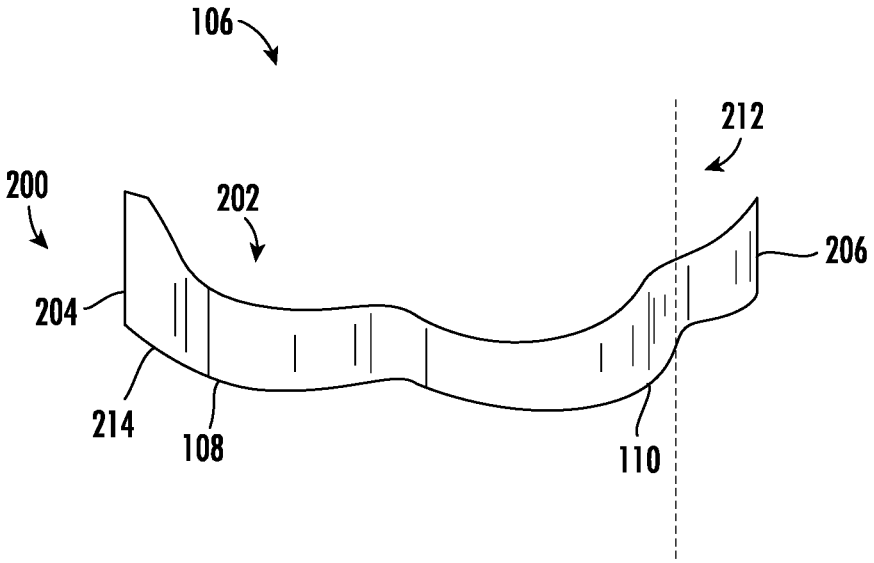
FIGS. 2A and 2B illustrate various views of a foldable chinstrap, in accordance with an example embodiment of the present disclosure.
Figure 2B:
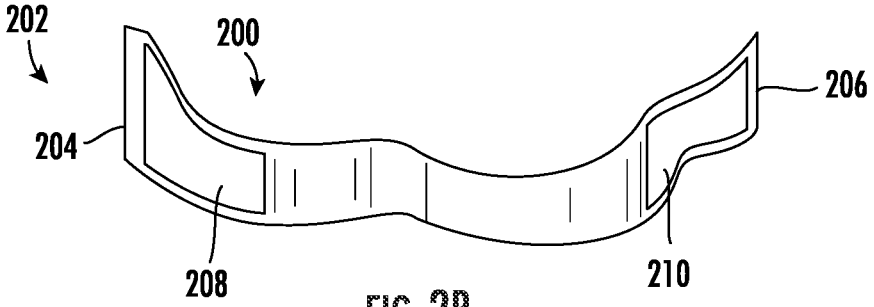

FIGS. 2A and 2B illustrate various views of the foldable chinstrap 106, in accordance with an example embodiment of the present disclosure. FIG. 2A illustrates a front view 200 of the foldable chinstrap 106 and FIG. 2B illustrates a back view 202 of the foldable chinstrap 106. In an example, the foldable chinstrap has predefined dimensions and pattern. The foldable chinstrap 106 is made of one of leather, a nylon webbing or an elastic cotton material. In an example, the chinstrap 106 comprises four layers, a first outer shell of exterior material, a layer of moisture barrier, a layer of thermal insulation material, and a second outer shell.

The foldable chinstrap 106 has a first end 204 and a second end 206. The foldable chinstrap 106 in one example, has a hook-and-pile attachment on both ends 204 and 206. For instance, the first end 204 has a hook-and-pile attachment 208 and the second end 206 has a hook-and-pile attachment 210. The hook-and-pile attachments 208 and 210 are of a predefined shapes of rectangular or square shaped strips as shown in the figures, to facilitate quick and easy attachment of the second end 206 to the hook-and-pile attachment 116 of the collar 104. The hook-and-pile attachment 208 is positioned close to the first end 204 such that in the folded configuration, the second end 206 can be attached to the first end 204, via the hook-and-pile attachments 208 and 210. In an example, the foldable chinstrap 106 is folded along an axis 212 when attached to the interior surface of the first section 112 in the folded configuration. The axis 212 is perpendicular to a length of the foldable chinstrap 106.

The foldable chinstrap 106 has an elastic portion 214 in the first segment 108 of the chinstrap 106. The elastic portion 214 allows stretching of the foldable chinstrap 106 when the foldable chinstrap 106 is extended and attached to the exterior surface of the second section 114 during use. The elastic portion 214 retracts when the foldable chinstrap 106 is separated from the hook-and-pile attachment 116 when the foldable chinstrap 106 is not in use. The retraction of the elastic portion 214 pulls the foldable chinstrap 106 inside the stowage pouch 118. Such an elastic portion 214 facilitates usage of the foldable chinstrap 106 with reduced length thereby providing improved stowage for the foldable chinstrap 106.

Figure 3:
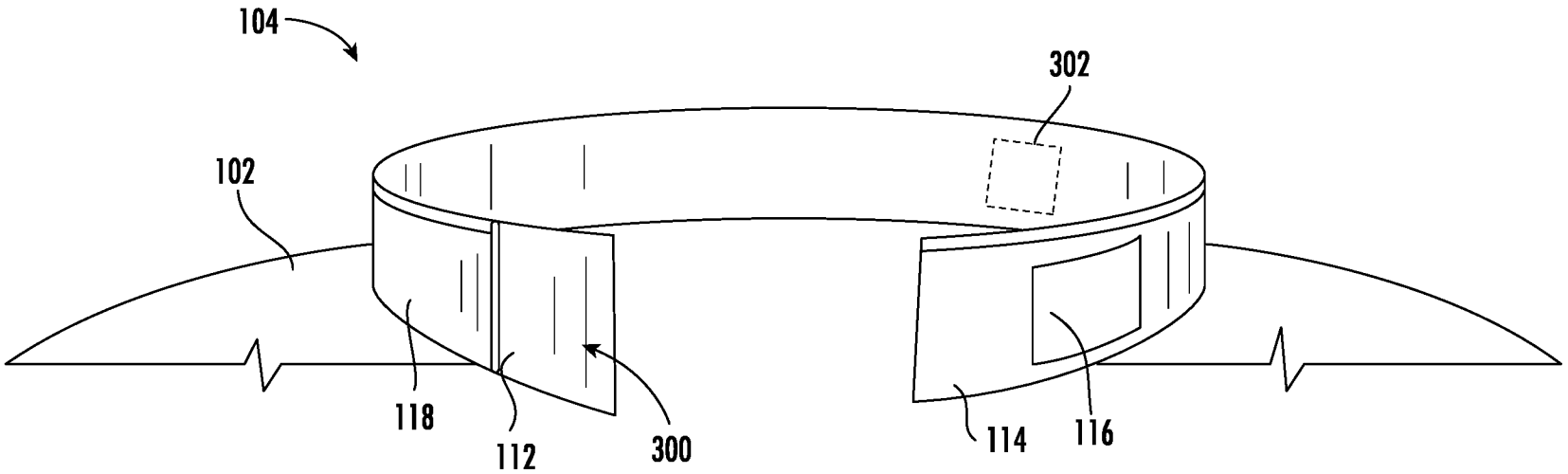
FIG. 3 illustrates a collar of a jacket worn by firefighters, in accordance with an example embodiment of the present disclosure.

FIG. 3 illustrates a front view of the collar 104 of the jacket 102. In an embodiment, the jacket 102 can be a protective jacket worn by the firefighters during firefighting. The jacket 102 has the collar 104 having the first section 112 and the second section 114. The second section 114 has the hook-and-pile attachment 116. The first section 112 has the stowage pouch 118 and the stowage pouch 118 defines a pocket 300 as shown in FIG. 3. In an example, the stowage pouch 118 extends along a portion of the length of the collar 104. In an example, a height of the stowage pouch 118 is less than a height of the collar 104. In an example, the collar 104 has an attachment point 302 on an exterior surface of the collar 104 within the stowage pouch 118. In an example, the first end 204 of the foldable chinstrap 106 is stitched or pasted to the exterior surface of the collar 104 at the attachment point 302.

Figure 4:
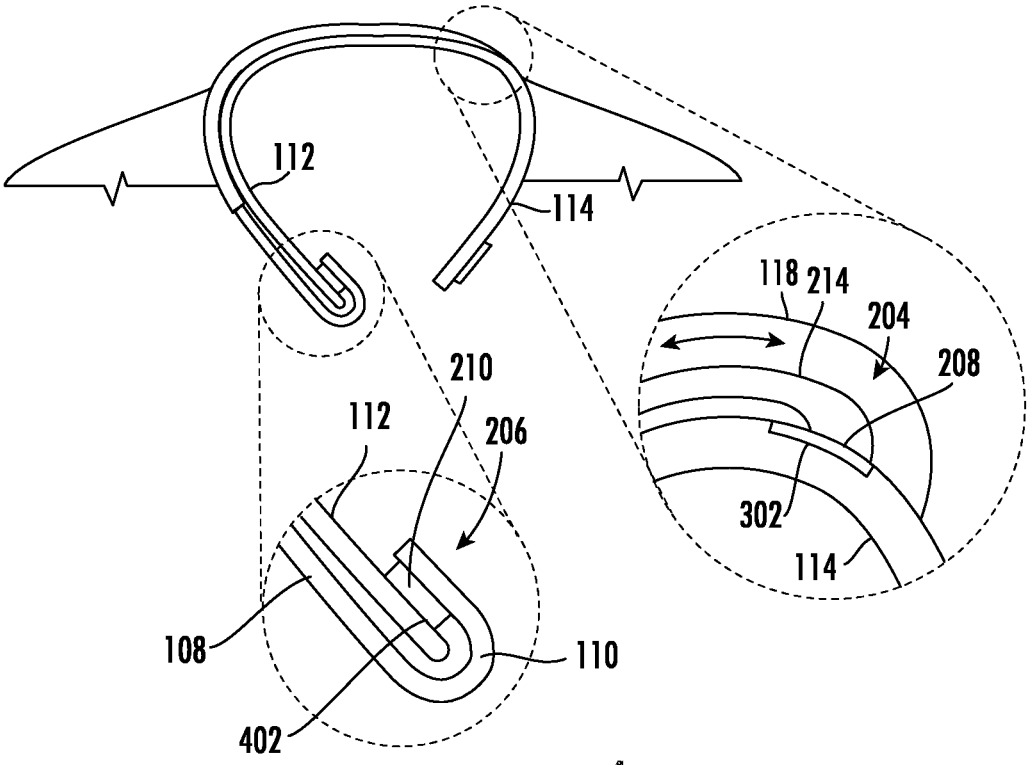
FIG. 4 illustrates two ends of a foldable chinstrap disposed within a stowable pouch of a collar, in accordance with an example embodiment of the present disclosure.

FIG. 4 shows the first end 204 stitched to the attachment point 302. In another embodiment, the attachment point 302 comprises a hook-and-pile attachment and the first end 204 is coupled to the attachment point 302 via the hook-and-pile attachment of the attachment point 302 and the hook-and-pile attachment 208 of the first end 204. In an example, the first section 112 has a hook-and-pile attachment 402 disposed on an interior surface of the first section 112. The hook-and-pile attachment 402 is positioned close to an end of the first section 112. The second end 206 is attached to the interior surface of the first section 112 via the hook-and-pile attachments 402 and 210. The foldable chinstrap 106 has the elastic portion 214 that stretches when the foldable chinstrap 106 is in use and retracts when the foldable chinstrap 106 is not in use. In an example, a width and the height of the stowage pouch 118 is selected such that the second end 206 can be easily inserted and removed from the stowage pouch 118.

In the alternative embodiment, the attachment point 302 is disposed on an interior surface of the first section 112. The first end 204 of the foldable chinstrap 106 is attached to the interior surface of the first section 112.

Figure 5A:
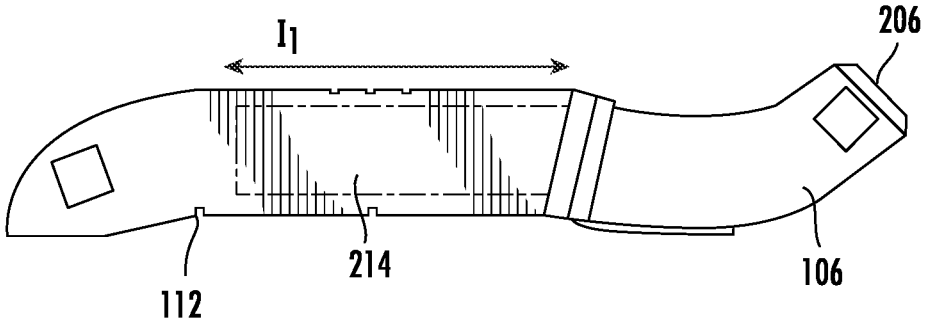
FIGS. 5A, 5B and 5C illustrate various views of a foldable chinstrap in use, in accordance with an example embodiment of the present disclosure.
Figure 5B:
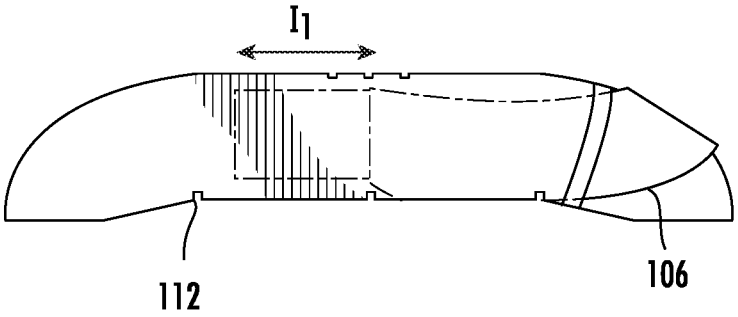
Figure 5C:
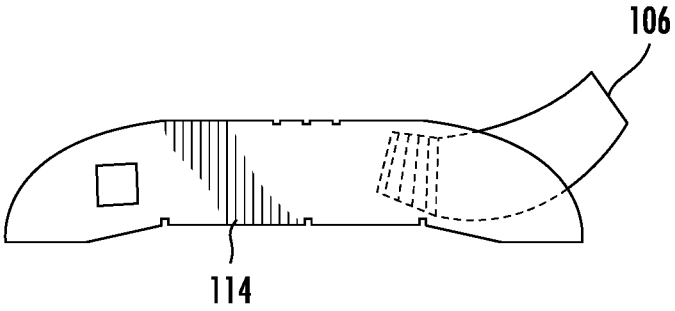

FIG. 5A, FIG. 5B and FIG. 5C illustrate various side views of the foldable chinstrap in use, in accordance with an example embodiment of the present disclosure. FIG. 5A shows the side view of the first section 112 of the collar 104 when the second end 206 is separated from the interior surface of the first section 112. In the position as shown in FIG. 5A, the foldable chinstrap 106 is positioned outside the stowage pouch 118 and not attached to the exterior surface of the collar 104 at the hook-and-pile attachment 116. The elastic portion 214, has a length $I_1$, is shown to be in a stretched configuration. FIG. 5B shows the side view of the first section 112 of the collar 104 when the foldable chinstrap 106 is removed from the first section 112 and attached to the exterior surface of the second section 114 of the collar 104. In this position, the length $I_1$ of the elastic portion 214 decreases as shown in FIG. 5B. FIG. 5C shows the side view of the second section 114 of the collar 104 when the foldable chinstrap 106 is removed from the first section 112 and attached to the exterior surface of the second section 114. In an example, the second end 206 of the foldable chinstrap 106 is attached to the hook-and-pile attachment 116 of the second section 114 of the collar 104.

Figure 6A:
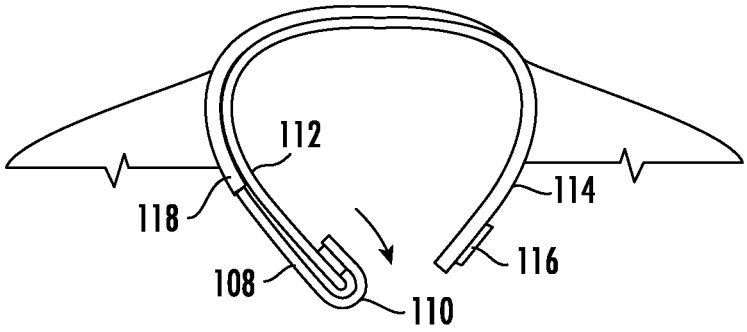
FIGS. 6A-6F illustrate working of a collar and a foldable chinstrap, in accordance with an example embodiment of the present disclosure.
Figure 6B:
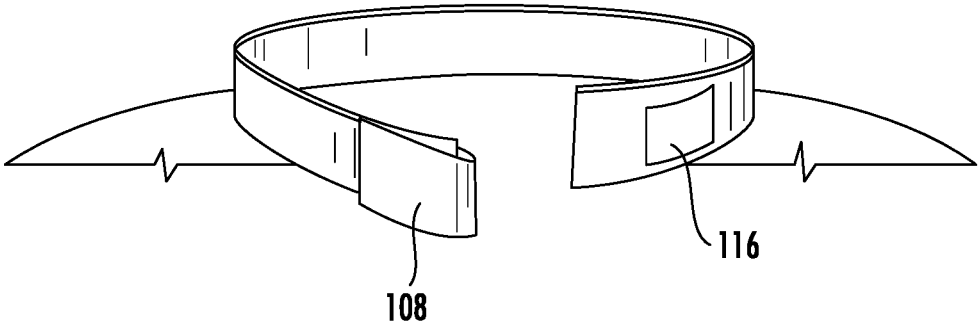
Figure 6C:
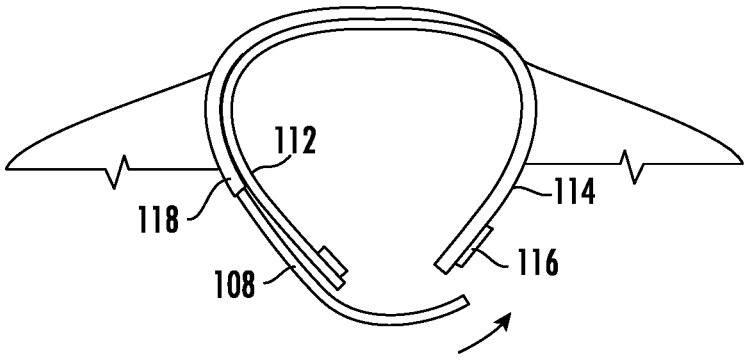
Figure 6D:
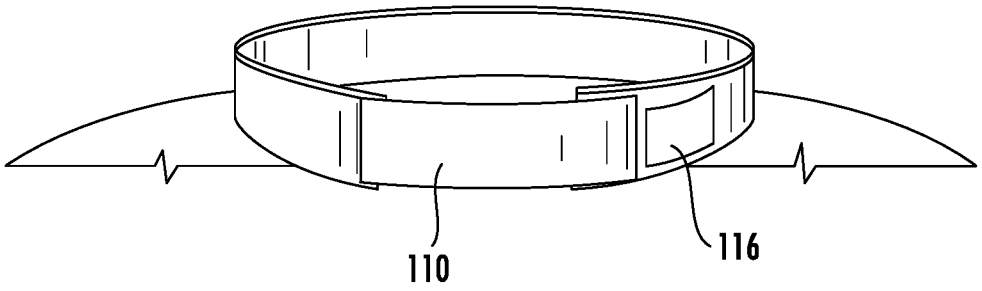

FIGS. 6A-6E illustrate various stages of transition from the folded configuration to an unfolded configuration of the foldable chinstrap 106 during use by the firefighter or the user, in accordance with an example embodiment of the present disclosure. FIGS. 6A and 6B shows the top view and the front view respectively and the foldable chinstrap 106 in the folded configuration where the first end 204 is disposed within the stowage pouch 118 and the second end 206 is attached to the interior surface of the first section 112. In the folded configuration, a portion of second segment 110 of the foldable chinstrap 106 is protruded out. The protruded portion is out and provides ease of grabbing by the firefighter during use. In an example, the second segment 110 is pulled out in the direction shown by the arrow and then extended and pulled towards the second section 114 to the unfolded configuration, as shown in FIGS. 6C and 6D. When the second end 206 is pulled and extended, the first end 204 of the foldable chinstrap 106 remains inside the stowage pouch 118 as the first end 204 is attached to the attachment point 302 on the exterior surface of the collar 104 and the elastic portion 214 stretches.

Figure 6E:
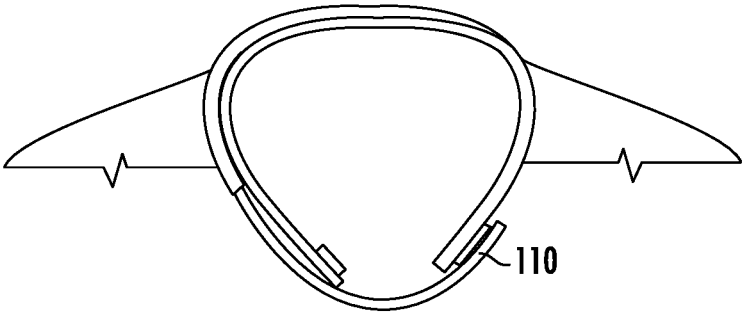
Figure 6F:
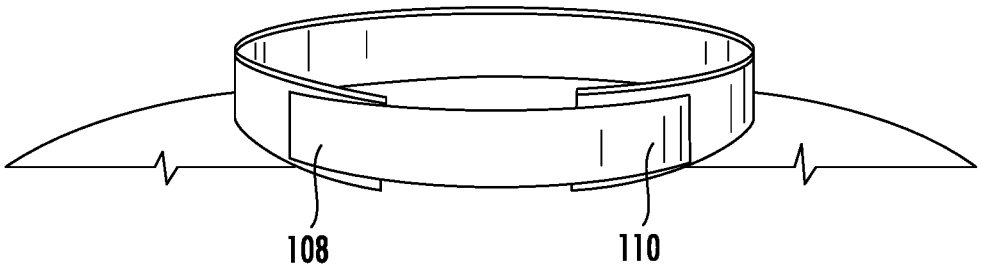

FIGS. 6E and 6F show the foldable chinstrap 106 is attached to the second section 114 of the collar 104. The firefighter couples the second end 206 on the hook-and-pile attachment 116, such that hook-and-pile attachment 210 of the foldable chinstrap 106 is attached with the hook-and-pile attachment 116 of the second section 114. In the position, as shown in FIGS. 6E and 6F, the foldable chinstrap 106 is wrapped around a front portion of the collar 104 and protects neck and face region of the firefighter.

In an example, when the foldable chinstrap is not in use, the firefighter pulls the second end 206 to decouple the second end 206 from the hook-and-pile attachment 116 and the elastic portion 214 retracts to pull the foldable chinstrap into the stowage pouch 118. The foldable chinstrap 106 is folded along the axis 212 and the second end 206 is attached to the hook-and-pile attachment 402 of the first section 112. In this manner, the foldable chinstrap 106 and the collar 104 prevent dangling of the foldable chinstrap 106 when the foldable chinstrap 106 is not in use thereby eliminating interference in visibility of the firefighter. Further, with such collar 104 and foldable chinstrap 106, the firefighter can conveniently insert or fold the foldable chinstrap 106 without separating or cutting the dangling foldable chinstrap, thereby preventing any safety related issues.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments, but not other embodiments.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present disclosure are disclosed herein; however, it is to be understood that the disclosed embodiments are merely exemplary, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

While it is apparent that the illustrative embodiments herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present disclosure.

What is claimed is:

1. A garment used by firefighters, the garment comprising:
a collar comprising two spaced-apart sections, wherein the collar defines a stowage pouch extending from a first section to a second section of the collar; and
a foldable chinstrap having a first end and a second end, wherein the first end is attached to an exterior surface of the collar and disposed within the stowage pouch and the second end is folded over the first section of the collar and attached to an interior surface of the first section of the two spaced-apart sections of the collar in a folded configuration, and the foldable chinstrap transitions from the folded configuration to an unfolded configuration when the second end of the foldable chinstrap is separated from the interior surface of the first section and attached to an exterior surface of a second section of the two spaced-apart sections, wherein the foldable chinstrap comprises an elastic portion configured to retract the foldable chinstrap into the stowage pouch when the second end of the foldable chinstrap is separated from the exterior surface of the second section of the two spaced-apart sections of the collar.

2. The garment of claim 1, wherein the first end of the foldable chinstrap is stitched to the collar.

3. The garment of claim 1, wherein the second end of the foldable chinstrap is removably attached to the interior surface of the first section in the folded configuration.

4. The garment of claim 3, wherein the second end is coupled to the interior surface of the first section via a hook-and-pile.

5. The garment of claim 1, wherein a height of the stowage pouch is less than a height of the collar.

6. The garment of claim 1, wherein the first end of the foldable chinstrap is attached to the collar at an attachment point on the exterior surface of the collar, wherein the attachment point is positioned on the second section of the collar.

7. The garment of claim 6, wherein the elastic portion of the chinstrap is positioned exterior of the second section of the collar.

8. The garment of claim 1, wherein the collar includes a perimeter along the exterior surface of the collar between the first section of the collar and the second section of the collar, wherein foldable chinstrap extends across more than 50% of the perimeter in the folded configuration.

9. A jacket having a collar, wherein the collar has two spaced-apart sections and defines a stowage pouch extending from a first section to a second section of the collar, wherein,
the stowage pouch is configured to receive a first end of a foldable chinstrap,
wherein a second section of the two spaced-apart sections has a hook-and-pile attachment on an exterior surface of the second section, and the second section is configured to allow a second end of the foldable chinstrap to attach to the second section, wherein the second end of the foldable chinstrap is folded over the first section of the collar and configured to be attached to an interior surface of the first section of the collar in a folded configuration, wherein the foldable chinstrap comprises an elastic portion configured to retract the foldable chinstrap into the stowage pouch when the second end of the foldable chinstrap is separated from the exterior surface of the second section of the two spaced-apart sections of the collar, wherein the first end of the foldable chinstrap is attached to an exterior surface of the collar.

10. The jacket of claim 9, wherein the stowage pouch has a predefined length configured to receive a portion of the foldable chinstrap.

11. The jacket of claim 10, wherein the first end of the foldable chinstrap is configured to be stitched to an exterior surface of the collar within the stowage pouch.

12. The jacket of claim 9, wherein the exterior surface of the collar comprises an attachment configured to attach the first end of the foldable chinstrap to the exterior surface of the collar.

13. The jacket of claim 9, wherein the second end of the foldable chinstrap is configured to be removably attached to the interior surface of the first section in the folded configuration.

14. A protective apparel comprising:

a collar comprising two spaced-apart sections, wherein the collar defines a stowage pouch extending from a first section to a second section of the collar, wherein a portion of a foldable chinstrap is disposed within the stowage pouch, wherein a first end of the foldable chinstrap is attached to an exterior surface of the collar within the stowage pouch and a second end of the foldable chinstrap is folded over the first section of the collar and removably attached to an interior surface of the collar in a folded configuration, and wherein the second end of the foldable chinstrap is configured to be removed from the interior surface of the collar and extended to attach to the exterior surface of the collar, wherein the foldable chinstrap comprises an elastic portion configured to retract the foldable chinstrap into the stowage pouch when the second end of the foldable chinstrap is separated from the exterior surface of a second section of the two spaced-apart sections of the collar.

15. The protective apparel of claim 14, wherein a portion of the foldable chinstrap, in the folded configuration, is disposed within the stowage pouch and a remaining portion of the foldable chinstrap is disposed outside the stowage pouch.

16. The protective apparel of claim 14, wherein the first end of the foldable chinstrap is stitched to the exterior surface of the collar within the stowage pouch.

17. The protective apparel of claim 14, wherein the second end is coupled to the interior surface of the collar, in the folded configuration, via a hook-and-pile.

18. The protective apparel of claim 14, wherein the exterior surface of the collar comprises a hook-and-pile configured to attach the second end to the exterior surface.

19. The protective apparel of claim 14, wherein the second end of the foldable chinstrap comprises a hook-and-pile attachment.

20. The protective apparel of claim 14, wherein the foldable chinstrap has a predefined shape and dimension to allow insertion of the foldable chinstrap into the stowage pouch and removal of the foldable chinstrap from the stowage pouch.

* * * * *